US005315068A

United States Patent [19]

Barron et al.

[11] Patent Number: 5,315,068

[45] Date of Patent: May 24, 1994

[54] TERMINAL BLOCK INSULATOR EXTENDER

[75] Inventors: Mary A. Barron, Cypress; Danny R. Williams, Houston, both of Tex.

[73] Assignee: Houston Industries Incorporated, Houston, Tex.

[21] Appl. No.: 730,278

[22] Filed: Jul. 11, 1991

[51] Int. Cl.[5] ..... H01B 17/00; H01R 9/24

[52] U.S. Cl. ..... 174/138 F; 174/138 E; 174/60; 361/823; 439/709; 439/710; 439/718

[58] Field of Search ..... 174/138 F, 5 R, 5 SB, 174/138 E, 59, 60, 135, 138 R, 148, 209; 439/710, 715, 718, 712, 709, 491, 717; 361/426

[56] References Cited

U.S. PATENT DOCUMENTS

| | | | |
|---|---|---|---|
| 1,813,200 | 7/1931 | Rogers | 174/5 R |
| 2,923,913 | 2/1960 | Kulka | 439/491 |
| 2,981,923 | 4/1961 | Ustin | 439/491 |
| 2,983,897 | 5/1961 | Blanchet | 439/718 X |
| 3,019,408 | 1/1962 | Ustin | 439/717 |
| 3,067,403 | 12/1962 | Kulka | 439/491 |
| 3,087,009 | 4/1963 | Blanchet | 174/135 |
| 3,201,747 | 8/1965 | Blanchet | 439/718 X |
| 3,247,480 | 4/1966 | Orzechowski | 439/718 |
| 3,275,972 | 9/1966 | Eisert | 439/491 |
| 3,328,511 | 6/1967 | Cagle et al. | 174/5 R X |
| 3,753,216 | 8/1973 | Johnson et al. | 439/491 |
| 3,778,682 | 12/1973 | Bright | 174/138 F X |
| 4,015,890 | 4/1977 | Glaesel | 439/491 |
| 4,040,711 | 8/1977 | Waddington et al. | 439/717 X |
| 4,197,945 | 4/1980 | Sherwood | 174/138 F X |
| 4,280,013 | 7/1981 | Clutter | 174/5 R |
| 4,697,720 | 10/1987 | Hotchkiss | 174/72 A |
| 4,714,434 | 12/1987 | Norden | 439/488 |
| 4,727,220 | 2/1988 | Wagener | 174/5 R |
| 4,768,982 | 9/1988 | Farag et al. | 439/892 |

FOREIGN PATENT DOCUMENTS

| | | | |
|---|---|---|---|
| 0230671 | 9/1990 | Japan | 439/715 |
| 853500 | 11/1960 | United Kingdom | 439/717 |

*Primary Examiner*—Leo P. Picard
*Assistant Examiner*—Hyung S. Sough
*Attorney, Agent, or Firm*—Pravel, Hewitt, Kimball & Krieger

[57] ABSTRACT

An extender or cover is provided for fitting over partition walls between adjacent sets of terminal points or connectors on an electrical terminal block. When installed, the extender serves as a mechanical barrier against inadvertent connection of terminals of different electrical polarity or potential. The extender also serves as a visible cautionary indicator, alerting the service crew to be aware of the risk of misconnection.

2 Claims, 1 Drawing Sheet

TERMINAL BLOCK INSULATOR EXTENDER

BACKGROUND OF INVENTION

1. Field of Invention

The present invention relates to extenders or covers fitted over electrical terminal blocks in electrical power distribution equipment.

2. Description of Prior Art

Terminal blocks have long been widely used in electrical utilities, serving as electrical connectors for electrical current power supplies and the like used in relaying, intercommunication and other signalling within power grids. Terminal blocks also have been used as connectors for relatively low voltage electrical power. Terminal blocks have been desirable because they facilitated assembly, installation and connection of electrical instruments and connectors. Further, there was no need to use splicing or soldering between individual conductors.

Terminal blocks have generally been designed to maximize their compactness. This was done to minimize the space required for them as well as for increased strength and lack of susceptibility to voltage breakdown.

An example prior art terminal block is of the type in U.S. Pat. No. 3,067,403. Other electrical terminal blocks are set forth in U.S. Pat. Nos. 2,923,913; 3,275,972; 3,247,480; 2,411,014; 4,697,720 and 4,637,676. Emphasis on compactness has caused certain problems. For example, sets of contacts carrying electricity at different polarities, phases or voltages were located adjacent each other. Even if care was taken, there was still a risk of misconnecting contacts of different potentials or polarities. This could cause arcing, fire or other problems. Although some terminal blocks had ribs or partition walls between electrical contacts, the risk of misconnection and the problems which could be caused were still of concern.

SUMMARY OF INVENTION

Briefly, the present invention provides a new and improved insulator extender for an insulation partition wall mounted between adjacent connector sets of electrical terminals in an electrical terminal block. An insulator extender according to the present invention has first and second side wall members formed to extend substantially parallel with the insulation partition wall. A spacer body member is mounted between the first and second side wall members along a portion of their extent with the insulation partition wall.

The first and second side wall members and the spacer body define an inner recess which is adapted to fit over an outer portion of the insulator partition wall. The first and second side wall members and the spacer body form an extension of the insulator partition wall when the partition wall is fitted into the inner recess. In this manner, an extender according to the present invention serves as a barrier against inadvertent connection of or between terminals of different sets.

DESCRIPTION OF THE PREFERRED EMBODIMENT

Figure 1:
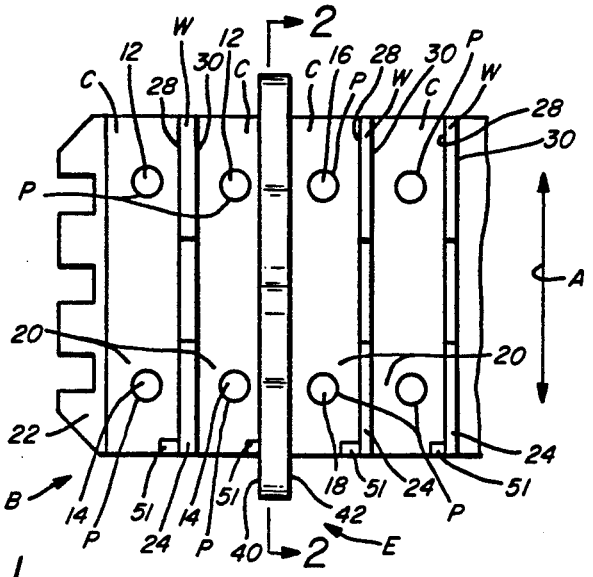
FIG. 1 is an elevation view of a terminal block for electrical power distribution equipment having an insulator extender according to the present invention.

In the drawings, the letter E designates generally an extender for an insulation partition wall W, also known in the art as an insulator rib. The partition wall W is mounted between adjacent ones of an array of connector sets C in an electrical terminal block B (FIG. 1) of electrical power distribution equipment. The terminal block B is of the conventional type used by electrical utilities to provide connection to electrical power supplies used in signal relaying or intercommunication between stations in electrical power grids.

The terminal block B may be formed of any suitable number of adjacent connector sets C depending upon power supply needs. Each connector set C includes a spaced connector pair of connector pins P. Each of the connector pins P is electrically conductive and is formed extending outwardly or upwardly. The connector pins P are typically externally threaded and adapted to receive conventional jumper connectors or plugs fitted onto the ends of electrical jumper wires.

The connector pins P for a connector set C include connector pins 12 and 14 formed in the manner set forth above. The connector pins 12 and 14 of an individual connector set C are spaced from each other along the length (as indicated by an arrow A) of an insulative terminal body 20, which is mounted as one of an array in the terminal block B with a connector plate 22 on a wall or other suitable surface.

It is often necessary to jumper together or connect in common pins P of adjacent sets at like operating voltage levels and polarities. For example, the connector pin 12 in each adjacent set could be jumpered together at a direct current voltage bias of +100 volts. The commonly connected pins 12 would be at a such a voltage level with respect to the ground or neutral lower pin 14 of both connector pin pairs P. However, it is also not uncommon for a terminal block B to have present connector sets C of several different voltage levels and opposite polarities at closely or even adjacently located positions to each other. Again for example, a connector pin 16 in a connector set adjacent the pin 12 could be at direct current voltage voltage bias of −100 volts or more with respect to a ground or neutral lower pin 18. If pins 12 and 16 of connector sets at different voltage levels or polarities are inadvertently jumpered or connected together, a risk of fire or explosion or other hazard is present.

Each of the partition walls W between connector sets C is a generally flat plate member 24 (FIGS. 2 and 3) of a suitable synthetic resin having insulative properties. The plate member 24 is generally rigid, but slightly flexible or pliant. The plate member 24 has a rear notch or slot 26 formed therein for mounting on the connector plate 22.

The plate member 24 of the partition wall W is fitted between an adjacent pair of terminal bodies 20 along side surfaces 28 and 30. The plate member 24 is generally of the same length (again indicated by arrow A) as the adjacent terminal bodies 20.

The plate member 24 extends upwardly or outwardly from between adjacent electrical terminals 20 a height (show schematically at 32) slightly greater than the outward or upward extension of the connector pins.

The plate member 24 also has a recessed center portion 34 formed between upper tab portions 35 and 36 for receipt therein of a laterally extending terminal marking strip of the type shown, for example, in U.S. Pat. No. 3,067,403.

Typically, a generally circular opening or passage 38 is formed in each of upper tab portions 35 and 36 extending between side walls 28 and 30 of the plate members 24. The openings 38 are normally for the purpose of receiving connector pins of the type used to pivotally connect the terminal marking strip to partition walls of the terminal block B.

Turning now to the structure of the extender E of the present invention, a first wall member 40 and a second wall member 42 are formed to extend substantially parallel with side walls 28 and 30 of the insulation partition wall W. The side wall member 40 is a generally flat sheet of suitably rigid insulating synthetic resin having outer or upper tab portions 44 and 46 at positions corresponding to the location of tab portions 35 and 36 of the partition W. When the partition wall W has a recessed portion 34, the wall member 40 has a correspondingly recessed portion 64 formed between outer tab portions 44 and 46. The side wall member 42 is of like construction to the foregoing portions of the sidewall member 40, and like structure accordingly bears like reference numerals.

Attachment lugs 50 are formed in at least one of the side wall members 40 and 42 at locations adapted to extend inwardly and fit into the openings 38 in the partition wall W. The attachment lugs 50 may be formed, for example, by being stamped in one or both of the side wall members 40 or 42, as the case may be. The attachment lugs 50 when fitted into the openings 38 serve as mounting members, interconnecting the extender E and the partition wall W to prevent inadvertent disconnection or dislodgement.

Certain commercially available insulation partition walls have an outwardly extending lug or pin 51 formed on at least one of the sidewalls 28 or 30 below one of the openings 38. Such pins and their function are not, however, material to the extenders E of the present invention, and the pins 51 are shown only for completeness of reference.

Where such a lug or pin 51 is present on the partition wall W, a receptor notch or slot 52 is formed at a corresponding sidewall member 40 or 42 as the case may be. The notch 52 is sized to fit over and receive within it the lug 51 when the extender E is mounted on the partition wall W with the lugs 50 fitted into the openings 38. In this manner, the extender E fits over the partition wall W in the same manner when pins 51 are present as when they are not.

The side wall members 40 and 42 of the extender E are spaced from each other and interconnected by a spacer body 54. The spacer body 54 is thus mounted between wall members 40 and 42. The spacer body 54, however, extends only along portions of the side wall members 40 and 42, as will be set forth. The spacer body 54 is formed from a like material to that of the side wall members 40 and 42. The spacer wall member 54 is of a thickness equal to or slightly greater than the thickness of the partition wall W.

The spacer wall member 54 has end portions 56 and 58 which extend sidewardly (FIG. 2) from tab portions 44 and 46 of the partition wall W. The spacer body 54 has upper wall portions 60 and 62 which extend upwardly above outer tab portions 44 and 46 of the partition wall W. A recessed portion or notch 64 is formed in the spacer body 54 between wall portions 60 and 62 at a location corresponding to that of the recessed portion 34 in partition wall W. Rounded corner portions 66 and 68 are formed as components of the spacer body 54 to connect the end portions 56 and 58 to the upper wall portions 60 and 62, respectively.

Figure 2:
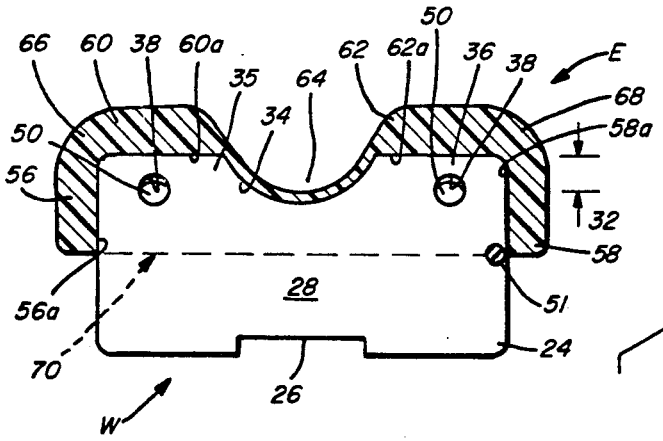
FIG. 2 is a cross-sectional view taken along the line 2—2 of FIG. 1.
Figure 3:
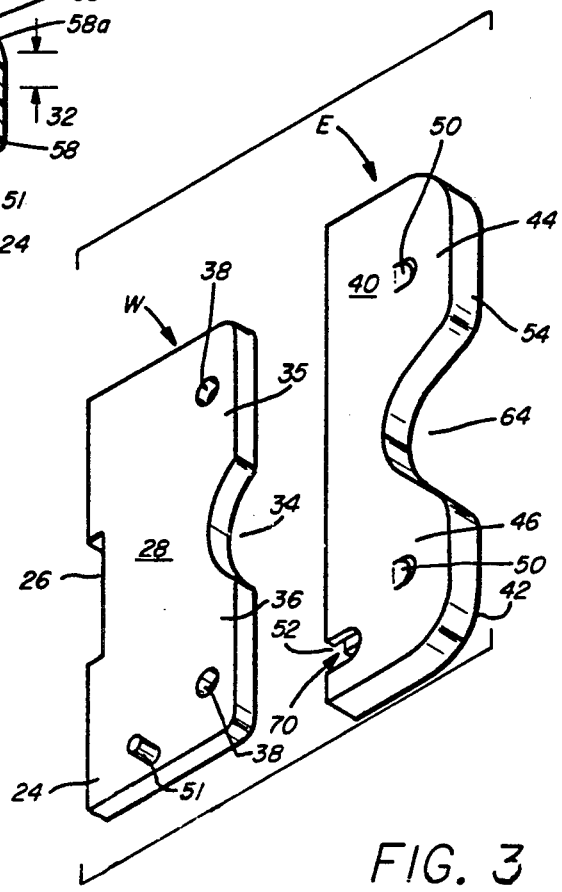
FIG. 3 is an exploded isometric view of an insulator extender and partition wall portion of the terminal block of FIG. 1.

The end portions 56 and 58, together with the corner portions 66 and 68 as well as the upper wall portions 60 and 62 of the spacer wall 54 conform to the silhouette or profile of the outer and upper portion of side wall members 40 and 42 (FIGS. 2 and 3). Inner surfaces **56*a* and 58*a* of end portions 56 and 58, and inner surfaces 60*a* and 62*a* of upper wall portion 60 and 62, together with inner surfaces of side wall members 40 and 42 define an inner recess 70 which is adapted to fit over the outer tab portions 35 and 36** of the partition wall W.

In the operation of the present invention, extenders E are installed on each of the partition walls W of the terminal blocks B. Such installation may be performed whether electrical power is present or not on the connector sets C of the terminal block B. The inner recess 70 is aligned over a partition wall W and the extender E is then slid downwardly. Extender E is moved downwardly until the attachment lug or lugs 50 snap and fit into the openings 38 in the tabs 35 and 36 of the partition wall W. When thus in place, the extenders E form upward extensions of insulation walls W. The extenders E accordingly serve as barriers against inadvertent connection of electrical terminals of adjacent connector sets of different voltages or polarities.

Although the side wall members 40 and 42 and the spacer wall member 54 have been described as separate pieces from each other, it should be understood that they may be more desirably integrally molded as a single integral body of a suitable insulative synthetic resin. The synthetic resin may also be of a suitable alerting or cautionary bright color. This permits the extenders E to provide a further visible indicator, further serving as a cautionary reminder against inadvertent misconnection of connector sets C of different voltages or polarities.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

We claim:

1. An extender for an insulation partition wall having openings formed therein and being mounted between adjacent connector sets in an electrical terminal block, comprising:

first and second side wall members formed to extend substantially parallel with the insulation partition wall;

a spacer body mounted between said first and second side wall members along a portion of the extent thereof;

said spacer body having a thickness substantially equal to that of the outer portion of the insulation partition wall;

said first and second side wall members and said spacer body defining an inner recess adapted to fit over an outer portion of the insulation partition wall;

mounting lugs formed extending into said inner recess from at least one of said first and second side wall members, said mounting lugs being adapted to fit within the openings in the insulation partition wall;

said inner recess being substantially equal in depth to an outer half portion of the insulation partition wall and substantially equal in length to the insulation partition wall;

said first and second side wall members and said spacer body having end portions extending beyond said inner recess in the direction of the length of the insulation partition wall at opposite ends thereof and having a recessed center portion; and said first and second side wall members and said spacer body extending from said inner recess an amount substantially equal to the depth of said inner recess, thereby forming an extension of the insulation partition wall when same is fitted into said inner recess, said extension serving as a barrier against misconnection of different connector sets.

2. The apparatus of claim 1, wherein said mounting lugs comprise:

mounting lugs formed extending into said inner recess from each of said first and second side wall members, said mounting lugs being adapted to fit within the openings in the insulation partition wall.

* * * * *